US011136892B2

(12) United States Patent
Gill et al.

(10) Patent No.: US 11,136,892 B2
(45) Date of Patent: Oct. 5, 2021

(54) ROTOR BLADE FOR A GAS TURBINE WITH A COOLED SWEEP EDGE

(71) Applicant: Siemens Aktiengesellschaft, Munich (DE)

(72) Inventors: Markus Gill, Ibbenbüren (DE); Christian Gindorf, Krefeld (DE); Andreas Heselhaus, Düsseldorf (DE); Robert Kunte, Düsseldorf (DE); Marcel Schlösser, Mülheim an der Ruhr (DE); Andrew Carlson, Jupiter, FL (US); Ross Peterson, Palm Beach Gardens, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 405 days.

(21) Appl. No.: 16/081,205

(22) PCT Filed: Mar. 1, 2017

(86) PCT No.: PCT/EP2017/054734
§ 371 (c)(1),
(2) Date: Aug. 30, 2018

(87) PCT Pub. No.: WO2017/153219
PCT Pub. Date: Sep. 14, 2017

(65) Prior Publication Data

US 2020/0386104 A1 Dec. 10, 2020

(30) Foreign Application Priority Data

Mar. 8, 2016 (EP) ..... 16159107

(51) Int. Cl.
*F01D 5/18* (2006.01)
*F01D 5/20* (2006.01)

(52) U.S. Cl.
CPC ..... *F01D 5/187* (2013.01); *F01D 5/186* (2013.01); *F01D 5/20* (2013.01); *F05D 2260/202* (2013.01)

(58) Field of Classification Search
CPC . F01D 5/20; F01D 5/187; F01D 5/186; F05D 2260/202
See application file for complete search history.

(56) References Cited

U.S. PATENT DOCUMENTS 5,261,789 A 11/1993 Butts et al.
5,733,102 A 3/1998 Lee et al.
(Continued)

FOREIGN PATENT DOCUMENTS

EP 1059419 A1 12/2000
EP 1281837 A1 2/2003
(Continued)

OTHER PUBLICATIONS

International Search Report dated May 10, 2017, for PCT/EP2017/054734.
(Continued)

*Primary Examiner* — Gonzalo Laguarda

(57) ABSTRACT

A rotor blade for a gas turbine, includes a blade extending in a radial direction, with a blade body having a peripheral wall with pressure-side and suction-side wall sections, a plate-shaped crown base connected to the peripheral wall in the region of the blade tip, and a sweep edge extending along the peripheral wall, the peripheral wall and the crown base defining a cavity in the blade body, the sweep edge being aligned on the outer side with the peripheral wall and protruding radially over the crown base, and cooling channels are embodied in the blade body, extending from the cavity to cooling fluid outlets provided in the sweep edge. At least one recess being formed in the front surface of the sweep edge, into which at least some of the cooling channels
(Continued)

flow such that the cooling fluid outlets are entirely arranged in a bottom region of the recess.

22 Claims, 4 Drawing Sheets

(56) References Cited

U.S. PATENT DOCUMENTS

| | | | | |
|---|---|---|---|---|
| 6,164,914 | A | 12/2000 | Correia et al. | |
| 6,224,336 | B1 * | 5/2001 | Kercher | F01D 5/186 415/115 |
| 7,494,319 | B1 * | 2/2009 | Liang | F01D 5/20 416/92 |
| 7,597,539 | B1 * | 10/2009 | Liang | F01D 5/186 416/97 R |
| 7,740,445 | B1 * | 6/2010 | Liang | F01D 5/20 415/173.5 |
| 8,061,987 | B1 * | 11/2011 | Liang | F01D 5/187 416/92 |
| 8,066,485 | B1 * | 11/2011 | Liang | F01D 5/186 416/97 R |
| 8,113,779 | B1 * | 2/2012 | Liang | F01D 5/20 416/92 |
| 8,182,221 | B1 * | 5/2012 | Liang | F01D 5/20 416/1 |
| 8,197,211 | B1 * | 6/2012 | Liang | F01D 5/282 416/97 R |
| 10,570,750 | B2 * | 2/2020 | Rathay | F01D 5/187 |
| 2003/0021684 | A1 | 1/2003 | Downs et al. | |
| 2008/0175716 | A1 | 7/2008 | Potier | |
| 2011/0255990 | A1 * | 10/2011 | Diamond | F01D 5/20 416/97 R |
| 2014/0322028 | A1 | 10/2014 | Grohens et al. | |
| 2020/0173288 | A1 * | 6/2020 | Honkomp | F01D 25/12 |

FOREIGN PATENT DOCUMENTS

| | | | |
|---|---|---|---|
| EP | 1911934 | A1 | 4/2008 |
| EP | 2378076 | A1 | 10/2011 |
| EP | 2780551 | A1 | 9/2014 |
| EP | 2863015 | A1 | 4/2015 |
| WO | 2013072610 | A1 | 5/2013 |

OTHER PUBLICATIONS

EP search report dated Sep. 28, 2016, for EP patent application No. 16159107.8.

* cited by examiner

ROTOR BLADE FOR A GAS TURBINE WITH A COOLED SWEEP EDGE

CROSS REFERENCE TO RELATED APPLICATIONS

This application is the US National Stage of International Application No. PCT/EP2017/054734 filed Mar. 1, 2017, and claims the benefit thereof. The International Application claims the benefit of European Application No. EP16159107 filed Mar. 8, 2016. All of the applications are incorporated by reference herein in their entirety.

FIELD OF INVENTION

The present invention relates to a rotor blade for a gas turbine, comprising a blade airfoil which extends in a radial direction and which has a blade airfoil body having a peripheral wall with a pressure-side wall section and a suction-side wall section, having a plate-like crown base which is connected to the peripheral wall in the region of the blade tip, and having a rubbing edge which extends along the peripheral wall, wherein the peripheral wall and the crown base define a cavity in the blade airfoil body, the rubbing edge is aligned on the outside with the peripheral wall and projects radially above the crown base, and in the blade airfoil body there are formed cooling ducts which extend from the cavity to cooling fluid outlet openings provided in the rubbing edge.

BACKGROUND OF INVENTION

In a gas turbine plant, thermal energy and/or flow energy of a hot gas generated by combustion of a fuel is converted into rotational energy, which is normally converted by means of a generator into electrical energy. For this purpose, the gas turbine plant has a flow duct in whose axial direction a turbine rotor is rotatably mounted. The latter comprises a plurality of wheel disks on whose radially outer end surfaces there is arranged in each case a plurality of rotor blades in the form of a blade ring. For this purpose, the rotor blades each have blade roots which are inserted into one or more receiving grooves, which are formed on the end surfaces of the wheel disks, and are fixed therein.

Formed on the top side of the blade roots are blade platforms, from whose outer sides, facing away from the wheel disk, blade airfoils project into the flow duct.

During the operation of the gas turbine plant, the hot gas flows through the flow duct, with the flowing hot gas acting on the rotor blades with a force which, owing to the shape of the blade airfoils, is converted into a torque which acts on the turbine rotor and which drives the turbine rotor in rotation.

The thermodynamic efficiency of gas turbine plants is greater the higher the hot gas temperature in the gas turbine plant is. However, the magnitude of the hot gas temperature is subject to limits owing to the thermal load capacity of the rotor blades. Accordingly, an objective is to provide rotor blades which, even in the case of high thermal loading, have a mechanical strength which is sufficient for the operation of the gas turbine plant. For this purpose, rotor blades are provided with elaborate coating systems. In order to further increase the maximum permissible hot gas temperature, rotor blades are cooled during the operation of the gas turbine plant. For this purpose, cavities and cooling ducts, through which a cooling fluid, normally air, flows, are formed in their interior. Common cooling methods are for example impingement cooling, in which the cooling fluid is conducted such that it impinges on the wall of the blade airfoil from the inside, or film cooling, in which the cooling fluid flows outwardly from the interior of the blade airfoil through cooling bores, formed in the blade airfoil body, in order to form a cooling film on the outer side of said airfoil.

It is thus known for example from U.S. Pat. No. 5,733,102 and US 2014/044557 A1 to produce the blade airfoils of cooled rotor blades in a casting process. Common cast blade airfoils each comprise a hollow blade airfoil body which is closed off in the region of the blade tip by a so-called crown base. In the region of the blade tip, the blade airfoil body also bears a rubbing edge which is molded on the outside onto the blade airfoil body in a flush manner and projects in the radial direction along the outer contour of the peripheral wall of the blade airfoil body. A narrow radial gap of predefined width remains between the rubbing edge and a duct wall, which delimits the flow duct of the gas turbine plant, in order to allow low-friction rotation of the turbine rotor in the flow duct, on the one hand, but only to allow a small part of the hot gas to flow unused through the radial gap, on the other hand. In order to protect the rubbing edge, it is known to form cooling ducts in the rubbing edge for the purpose of cooling, which ducts extend from the cavity to cooling fluid outlet openings which are formed in the end surfaces of the rubbing edge.

After a specific operating duration of the turbine plant, changes in the radial gap can occur. For example, the turbine rotor can depart from its original central position due to creep, the length of the rotor blades can increase as a result of the centrifugal force, or a flow duct which is originally circular can become oval. These effects result from setting and/or elongation as a result of thermal loading by the hot gas and/or rotation-induced centrifugal forces or the force of gravity. The contact between the end surfaces of the rubbing edges and the duct wall which is thereby brought about leads to friction-induced removal of material, in the form of metal dust or metal chips, from the rubbing edges. It is then possible for the cooling fluid outlet openings to be clogged with the removed blade airfoil material, as a result of which cooling of the rubbing edges is impaired or prevented. The insufficient cooling of the rubbing edges leads to greater wear and, consequently, to a shorter service life of the blade airfoils.

EP 2 378 076 A1 thus discloses the blade tip of a turbine rotor blade, which blade tip is widened to form a winglet. The winglet projects on both sides of the blade airfoil of the rotor blade and is provided with a relatively narrow slot at the radial outside. The walls of the slot are of stepped form in one section, such that cooling openings open in the step. The radially outwardly facing wing surface is provided with an abrasive material in order to remove an abradable material on the opposite ring segments during a run-in phase and thus to provide the smallest possible radial gap between the blade tip and the opposite hot gas wall. Owing to the provision of a supply to the slot, which is arranged in the blade tip along the blade profile, and to the film-cooling bores arranged in the step, it is possible for abraded material to be carried out by the cooling medium flowing along the slot.

Furthermore, it is known from EP 1 281 837 A1 that cooling bores extending through the blade tip partly also extend in the inwardly facing surfaces of rubbing edges. In this way, improved cooling of rubbing edges of turbine blades is intended to be achieved.

EP 2 863 015 A1 discloses a similar arrangement with a step on the inner surface of a rubbing edge.

SUMMARY OF INVENTION

Proceeding from said prior art, it is an object of the present invention to provide a rotor blade for a gas turbine of the type mentioned in the introduction, which blade has an alternative structure and allows reliable cooling of the rubbing edge.

In order to achieve said object, the present invention provides a rotor blade for a gas turbine of the type mentioned in the introduction, wherein, in the end surface of the rubbing edge, there is formed at least one depression into which at least some of the cooling ducts open such that the cooling fluid outlet openings are completely situated in a base region of the at least one depression.

The invention is based on the consideration of lowering, with respect to the radial direction, the cooling fluid outlet openings in relation to the end surface of the rubbing edge. This is brought about according to the invention in that at least one depression is formed in the end surface of the rubbing edge and at least some of the cooling outlet openings are arranged completely in a base region of the at least one depression. In this way, the cooling fluid outlet openings are at a distance from the contact region between the end surface of the rubbing edge and the duct wall, as a result of which clogging of the cooling fluid outlet openings with removed blade airfoil material is reduced or prevented. Consequently, the cooling performance is substantially maintained over the operating duration of the gas turbine plant, this being associated with a correspondingly long service life of the blade airfoils.

Furthermore, with respect to the radial direction, the base region of the at least one depression is arranged between the end surface of the rubbing edge and the outer surface of the crown base. Advantageously here, the base region is formed as a planar base surface which, in relation to the end surface, has a depth which lies in the range of 0.5 mm to 4.5 mm and advantageously in the range of 0.5 mm to 2.5 mm. Such a radial position of the base region has the effect that, firstly, the cooling fluid outlet openings are arranged in the immediate proximity of the free end region of the rubbing edge, as a result of which effective cooling of this region of the rubbing edge can be ensured. Secondly, the low depth of the base surface of the depression in relation to the end surface is sufficient to prevent material particles removed from the end surface from clogging the cooling fluid outlet openings, this being associated with uniform cooling performance.

In a known manner, with respect to the radial direction, the rubbing edge has, in relation to the outer surface of the crown base, an overall height which lies in the range of 1 mm to 10 mm, advantageously in the range of 1.5 mm to 6 mm, and is advantageously 3.5 mm. In rubbing edges with an overall height in this range, the depressions can be readily formed with a suitable depth.

Furthermore, in relation to the radial direction, an inner surface of the rubbing edge is outwardly inclined so as to form a first inclination angle, wherein the first inclination angle is measured in a plane which extends in the radial direction and which perpendicularly intersects the rubbing edge, lies in the range of 0° to 45° and is advantageously greater than 10° and/or less than 30°. As a result of the inclination of the inner surface of the rubbing edge, the rubbing edge widens in the direction of the crown base from the end surface. This improves the stability of the rubbing edge and additionally improves the heat transport between the rubbing edge and the crown base or the peripheral wall.

Moreover, the at least one depression extends as far as an inner side of the rubbing edge so as to form a stepped cross section, wherein in particular, a step corner of the cross section, advantageously the inner corner, is rounded. In this configuration, at least one depression is formed so as to be open toward the inner side. Such depressions may be easily produced already during the casting of the blade airfoil body or only retroactively for example by milling or erosion.

Also, each cooling duct is, in relation to a plane which is perpendicular to the radial direction, inclined in the direction of the leading edge of the rotor blade, or in the direction of the trailing edge of the rotor blade, so as to form a third and/or fourth inclination angle, wherein the third inclination angle in the direction of the trailing edge of the rotor blade and the fourth inclination angle in the direction of the leading edge of the rotor blade are each measured in a plane which perpendicularly intersects the measurement plane of the first inclination angle, lies in the range between 30° and 90°, more advantageously between 30° and 80°, and is in particular 45°. Cooling ducts having such an inclination in the direction of the leading edge or in the direction of the trailing edge have a longer length, as a result of which the convective cooling of the rubbing edge is able to improve. In particular, an arrangement of cooling ducts which is inclined with respect to the trailing edge results in the jets being conducted above the tips of the suction-side rubbing edge and, there, cooling the surface, where it is generally the hottest. Moreover, they are able to favorably influence the flow direction of the exiting cooling fluid. Cooling ducts of different inclination directions may penetrate one another or may cross without penetration.

Advantageously, in the region of the at least one depression, the end surface of the rubbing edge has a width which is less than the thickness of the peripheral wall of the blade airfoil body in the region of the at least one depression. In addition, in the region of the depression, the end surface of the rubbing edge may have a width which is less than the width of the base region of the at least one depression. In this way, only a relatively narrow outer region of the rubbing edge forms its radially outer end region.

Advantageously, in the region of the at least one depression, the end surface of the rubbing edge and the base region of the at least one depression have, in combination, a width which is approximately equal to the thickness of the peripheral wall of the blade airfoil body in the region of the at least one depression. Such rubbing edges essentially constitute an extension of the peripheral wall of the blade airfoil body above the crown base.

It is alternately possible for the depression in the end surface of the rubbing edge to be formed as a groove, with an outer end-surface section and an inner end-surface section being left in the process, wherein in particular, the inner corners of the depression are rounded.

In this case, in the region of the depression, the width of the outer end-surface section and the width of the inner end-surface section of the rubbing edge may each lie in the range of 0.5 mm to 5 mm and advantageously be at least 1 mm, wherein the ratio between the outer width and the inner width lies in the range between 0.7 mm and 1.3 mm, in particular 0.9 and 1.1, and is advantageously 1.

According to a further variant, in the region of the depression, the peripheral wall narrows in the direction of the crown base in favor of the cavity, wherein the thickness of the peripheral wall is reduced from an initial thickness to a narrowed thickness which is at least half as large as the initial thickness, and the narrowing occurs over a radial section of the peripheral wall, the height of which radial section is at least five times and at most ten times as large as the initial thickness. As a result of the reduced thickness of the peripheral wall immediately below the crown base, it is possible for the cooling ducts to be formed such that they extend closer to the outer side of the rubbing edge, this being associated with improved convective cooling of the rubbing edge.

In the at least one depression, the cooling fluid outlet openings are advantageously arranged mutually adjacently and spaced apart from one another, in particular in an equidistant manner and/or along a line. Cooling fluid outlet openings arranged in such a way are especially suited for cooling the rubbing edge along its peripheral extent. In principle, however, the cooling fluid outlet openings may be distributed in any desired manner.

In a rotor blade according to the invention, the at least one depression may be provided only in a section of the rubbing edge which projects from the suction-side wall section of the surrounding wall. In this way, the cooling of the section of the rubbing edge which projects from the suction-side wall section of the peripheral wall can be improved.

In one variant of the present invention, precisely one depression is provided. This leads to a particularly simple embodiment of a rotor blade according to the invention.

Alternatively, it is possible to provide a plurality of depressions which are arranged mutually adjacently in the peripheral direction, into each of which some of the cooling ducts open and which in particular each have at least one above-mentioned feature. Multiple depressions lead to a corresponding grouping of the cooling ducts.

According to one variant, each cooling duct extends rectilinearly and/or has a circular cross section with a diameter which lies in the range of 0.25 mm to 2 mm and is advantageously 0.6 mm.

Here, the cooling ducts may be widened in the region of the cooling fluid outlet openings, wherein the widenings in particular have the form of a cylinder whose height is at most five times as large as, advantageously as large as, the diameter of the cooling duct and/or whose diameter is at most three times as large as, advantageously twice as large as, the diameter of the cooling duct. Cooling fluid outlet openings widened in this way may act as a diffusor and correspondingly widen the exiting cooling fluid stream, with the result that a large region of the rubbing edge can be cooled in accordance with the principle of film cooling. As an alternative to the cylindrical form, the cooling fluid outlet openings may also be widened conically, semi-conically or in a fan-like manner.

Advantageously, the cooling ducts are formed as bores. Bores allow rectilinear cooling ducts with circular cross section to be easily introduced into a cast blade airfoil body.

Advantageously, in relation to the radial direction, the cooling ducts are inclined transversely with respect to the inner surface of the rubbing edge so as to form a second inclination angle, wherein in particular, the second inclination angles of the cooling ducts, which angles are each measured in a plane which extends in the radial direction and which perpendicularly intersects the rubbing edge, are equal or approximately equal to the first inclination angle of the inner surface of the rubbing edge. Cooling ducts having such an inclination conduct from the inside to the outer end region of the rubbing edge the cooling fluid exiting the cooling fluid outlet openings.

According to a further development, a transition region between an inner surface of the rubbing edge and the outer surface of the crown base is rounded. This improves the aerodynamic properties of the blade tip. Otherwise, the inner surface of the rubbing edge is, as viewed along the radial direction, largely rectilinear.

In a manner known per se, the blade airfoil body is produced by casting or in a generative process, in particular by means of 3D printing. Casting has proven to be a suitable production process in particular for cooled blade airfoils having a cavity in their interior. However, generative processes are also suitable for producing blade airfoil bodies.

BRIEF DESCRIPTION OF THE DRAWINGS

Further advantages and features of the present invention will become clear on the basis of six embodiments of a rotor blade according to the invention with reference to the appended drawing, in which.

DETAILED DESCRIPTION OF INVENTION

Figure 1:
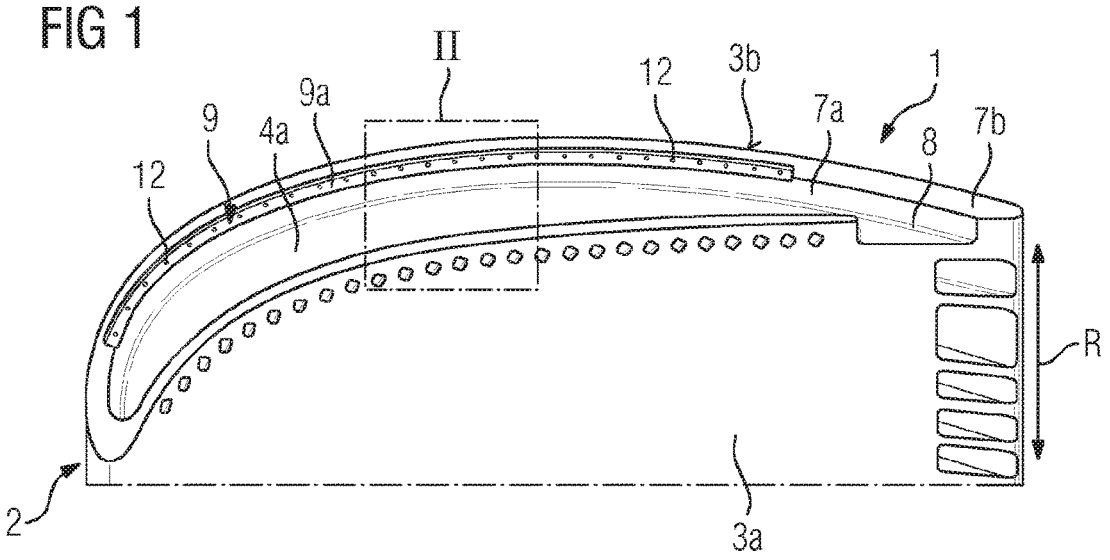
FIG. 1 shows a perspective partial view of a blade airfoil of a rotor blade according to a first embodiment of the present invention.
Figure 2:
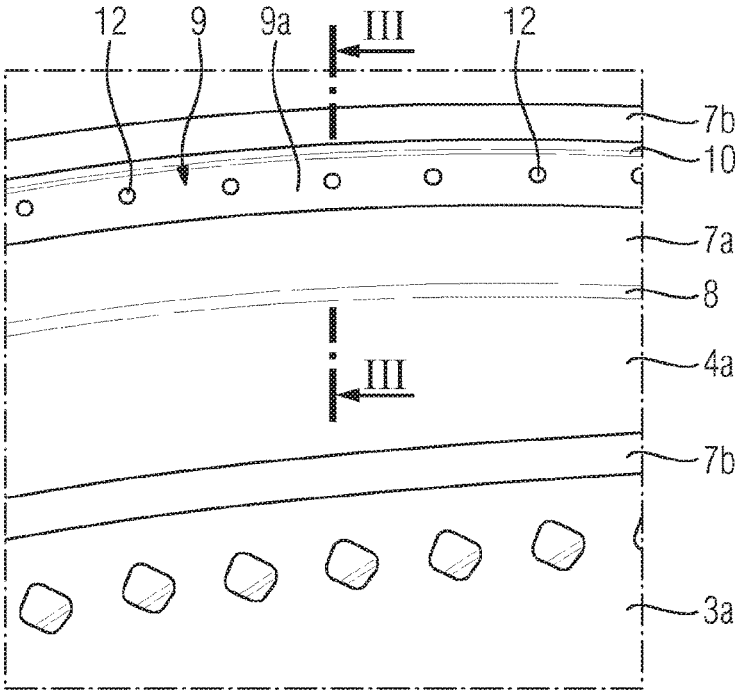
FIG. 2 shows an enlarged partial view of the rotor blade illustrated in FIG. 1.
Figure 3:
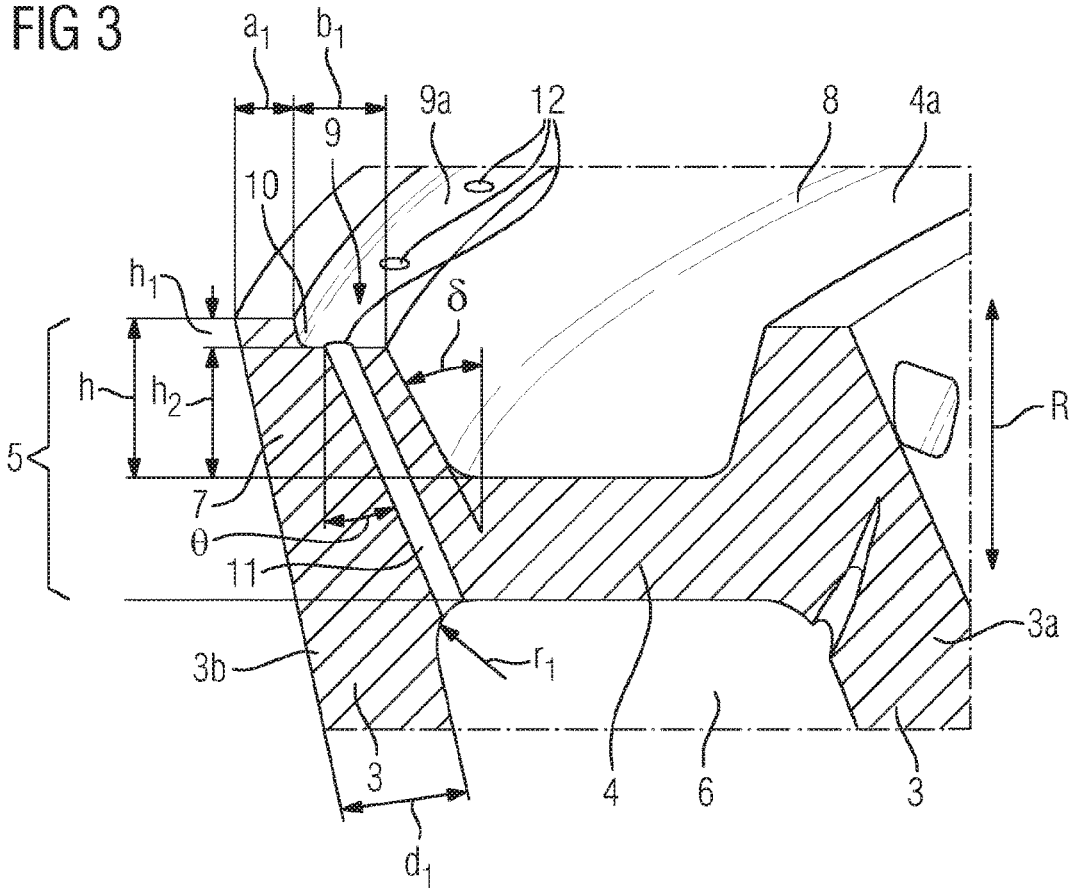
FIG. 3 shows an enlarged cross-sectional view of the rotor blade illustrated in FIG. 2 along the line denoted by III.

FIGS. 1 to 3 show a rotor blade for a gas turbine according to a first embodiment of the present invention. The rotor blade comprises a blade airfoil 1, which extends in a radial direction R and has a cast blade airfoil body 2. The blade airfoil body 2 has a peripheral wall 3, which has a pressure-side wall section 3*a* and a suction-side wall section 3*b*. The blade airfoil body 2 also comprises a plate-like crown base 4, which is connected to the peripheral wall 3 in the region of the blade tip 5. The peripheral wall 3 and the crown base 4 define, in the blade airfoil body 2, a cavity 6 through which a cooling fluid flows during the operation of the gas turbine.

The blade airfoil body 2 furthermore comprises a rubbing edge 7. The rubbing edge 7 extends along the peripheral wall 3 and is aligned on the outside therewith. In this case, the rubbing edge 7 projects radially above the crown base 4 and, with respect to the radial direction R, has, in relation to the outer surface 4*a* of the crown base, an overall height h, which is measured perpendicular to the outer surface 4*a* of the crown base and is approximately 3 mm. According to the cross-sectional view, an inner surface 7*a* of the rubbing edge 7 is formed to be largely rectilinear and is inclined at a first inclination angle δ of approximately 25° in relation to the radial direction R, said angle being measured in a plane which extends in the radial direction (R) and which perpendicularly intersects the rubbing edge 7. A transition region 8 between the inner surface 7*a* of the rubbing edge 7 and the outer surface 4*a* of the crown base 4 is formed to be rounded.

In a section of the rubbing edge 7 projecting from the suction-side wall section of the peripheral wall 3, there is formed a depression 9 which extends as far as the inner side of the rubbing edge 7 so as to form a stepped cross section. In this case, the inner corner 10 of the stepped cross section is rounded. The base region 9*a* of the depression 9 is formed as a planar base surface and, with respect to the radial direction R, is arranged between the end surface 7*b* of the rubbing edge 7 and the outer surface 4*a* of the crown base 4. Here, the outer surface 4*a* of the crown base 4, the base surface 9*a* of the depression 9 and the end surface 7*b* of the rubbing edge 7 extend parallel to one another and perpendicular to the radial direction R. In this way, the depression 9 has, in relation to the end surface 7*b*, a depth $h_1$, which is measured as the perpendicular distance between the base surface 9*a* and the end surface 7*b* and is approximately 1 mm. Correspondingly, the perpendicularly measured height $h_2$ of the base surface of the depression 9 above the outer surface 4*a* of the crown base 4 is approximately 2 mm. It is also possible, however, for the base surface 9*a* of the depression 9 and the outer surface 4*a* of the crown base 4 to be inclined with respect to one another and/or with respect to the radial direction R, it then being necessary for the depth $h_1$ or the height $h_2$ to in each case be determined with respect to the inner corner 10.

In the region of the depression 9, the end surface 7*b* of the rubbing edge 7 has a width $a_1$ which is less than the thickness $d_1$ of the peripheral wall 3 of the blade airfoil body 2 in the region of the depression 9. Moreover, in the region of the depression 9, the width $a_1$ of the end surface 7*b* of the rubbing edge 7 is less than the width $b_1$ of the base region 9*a* of the depression 9. In combination, the end surface 7*b* of the rubbing edge 7 and the base region 9*a* of the depression 9 have a width $a_1+b_1$ which is approximately equal to the thickness $d_1$ of the peripheral wall 3 of the blade airfoil body 2 in the region of the depression 9, the thickness $d_1$ being measured as the perpendicular distance between the outer surface and the inner surface of the surrounding wall 3. As can be seen in FIG. 3, the widths $a_1$ and $b_1$ are each measured parallel to one another and to the outer surface 4*a* of the crown base 4. Other embodiments of the present invention may have relative size ratios of the widths $a_1$ and $b_1$ and of the thickness $d_1$ which differ from those selected here.

Cooling ducts 11, which extend from the cavity 6 to cooling fluid outlet openings 12 which are provided in the rubbing edge 7, are formed in the blade airfoil body 2. The cooling ducts 11 open into the depression 9 such that the cooling fluid outlet openings 12 are arranged completely in the base region 9*a* of the depression 9. In this case, the cooling fluid outlet openings 12 are arranged in the depression 9 mutually adjacently in an equidistant manner and along a line. Each cooling duct 11 is formed as a bore and extends rectilinearly. It has a circular cross section with a diameter which is approximately 0.6 mm. In relation to the radial direction R, each cooling duct 11 is inclined transversely with respect to the inner surface 7*a* of the rubbing edge 7, with the second inclination angles θ of the cooling ducts 11, which angles are each measured in a plane which extends in the radial direction R and which perpendicularly intersects the rubbing edge 7, being approximately equal to the first inclination angle δ of the inner surface 7*a* of the rubbing edge 7.

Figure 4:
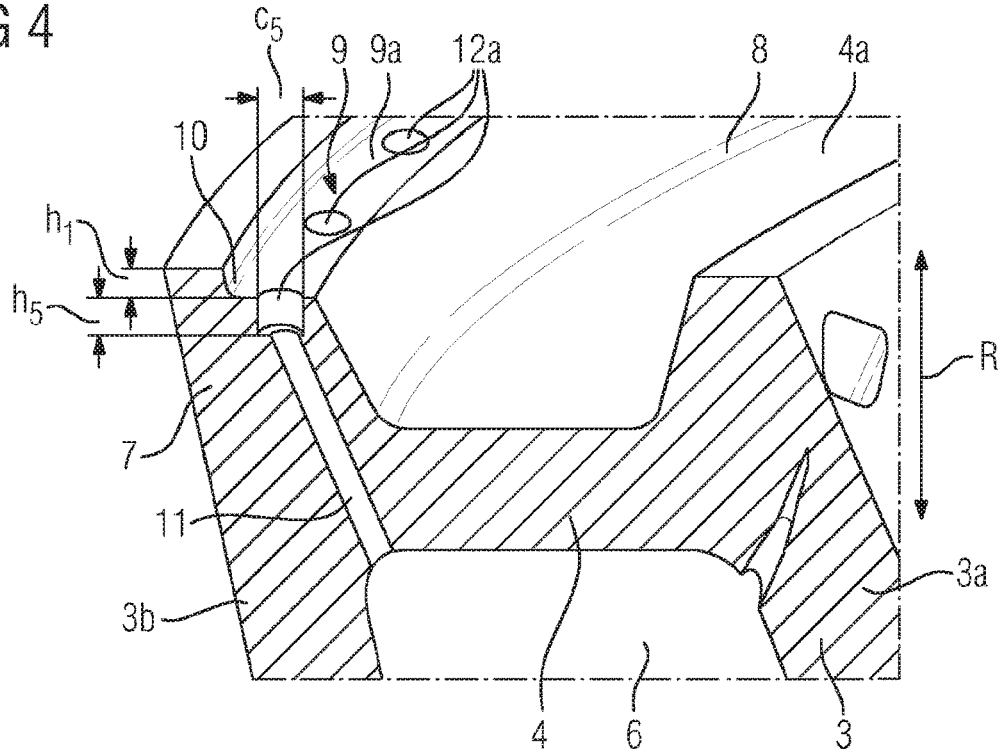
FIG. 4 shows an enlarged cross-sectional view of a blade airfoil of a rotor blade according to a second embodiment of the present invention, which corresponds to FIG. 3.

FIG. 4 shows a rotor blade for a gas turbine according to a second embodiment of the present invention. The structure of this rotor blade basically corresponds to the structure of the first embodiment illustrated in FIGS. 1 to 3. Here, in deviation therefrom, the cooling ducts are widened in the region of the cooling fluid outlet openings. The widened cooling fluid opening 12*a* has the form of a cylinder whose height $h_5$ is equal to the diameter of the cooling duct 11 and whose diameter $c_5$ is twice as large as the diameter of the cooling duct 11, which for the cylinder results in a cross-sectional area which is four times as large as the cross-sectional area of the cooling duct 11. In this embodiment, a widened cooling stream by way of which a large area of the rubbing edge 7 can be cooled is correspondingly produced during the operation of the rotor blade.

Figure 5:
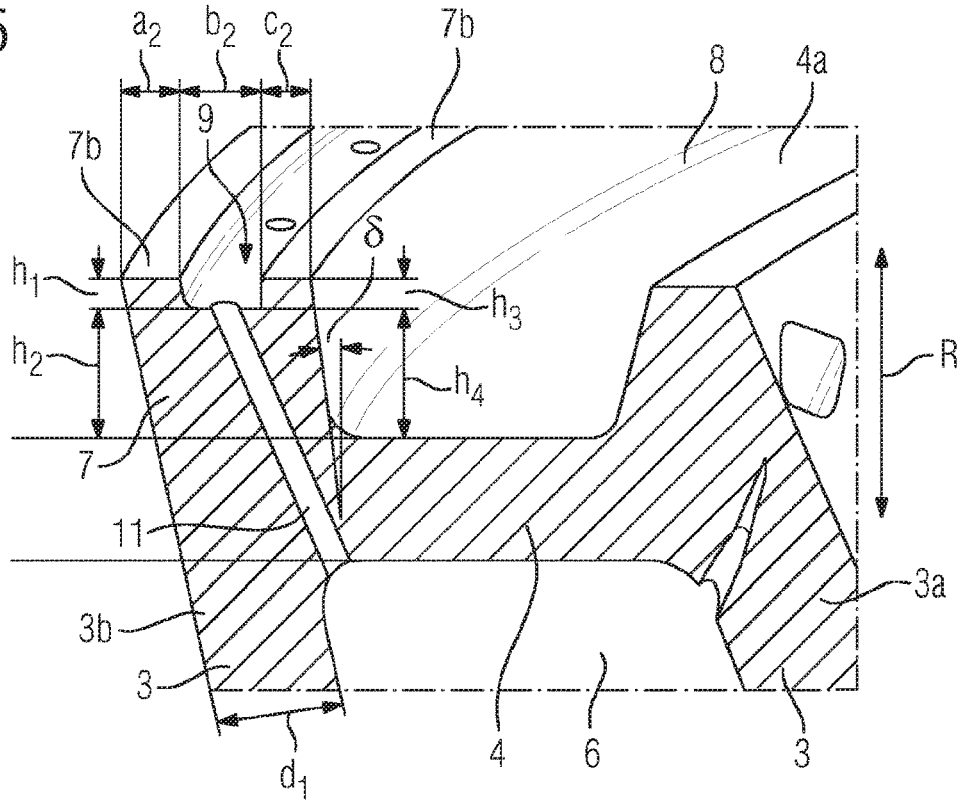
FIG. 5 shows an enlarged cross-sectional view of a blade airfoil of a rotor blade according to a third embodiment of the present invention, which corresponds to FIG. 3.

FIG. 5 shows a rotor blade for a gas turbine according to a third embodiment of the present invention. Said rotor blade basically has the same structure as the rotor blade illustrated in FIGS. 1 to 3. In contrast thereto, the depression 9 is formed as a groove, with an outer end-surface section and an inner end-surface section being left in the process, and thus does not extend as far as the inner side of the rubbing edge 7 but rather is also delimited on the inner side by the rubbing edge 7. Here, the outer-side end surface 7*b* has a width $a_2$, the inner-side end surface 7*b* has a width $c_2$ and the base region 9*a* of the depression 9 has a width $b_2$. This results in a combined width of $a_2+b_2+c_2$ for the rubbing edge 7 in the region of the depression 9, said width being greater than the thickness $d_1$ of the peripheral wall 3 of the blade airfoil body 2. Consequently, the first inclination angle δ of the inner surface 7*a* of the rubbing edge 7 in relation to the radial direction R is correspondingly smaller. The inner-side height $(h_3+h_4)$ of the rubbing edge 7 is, in the present case, equal to the outer-side height $(h=h_1+h_2)$ of the rubbing edge, but may also differ therefrom.

Figure 6:
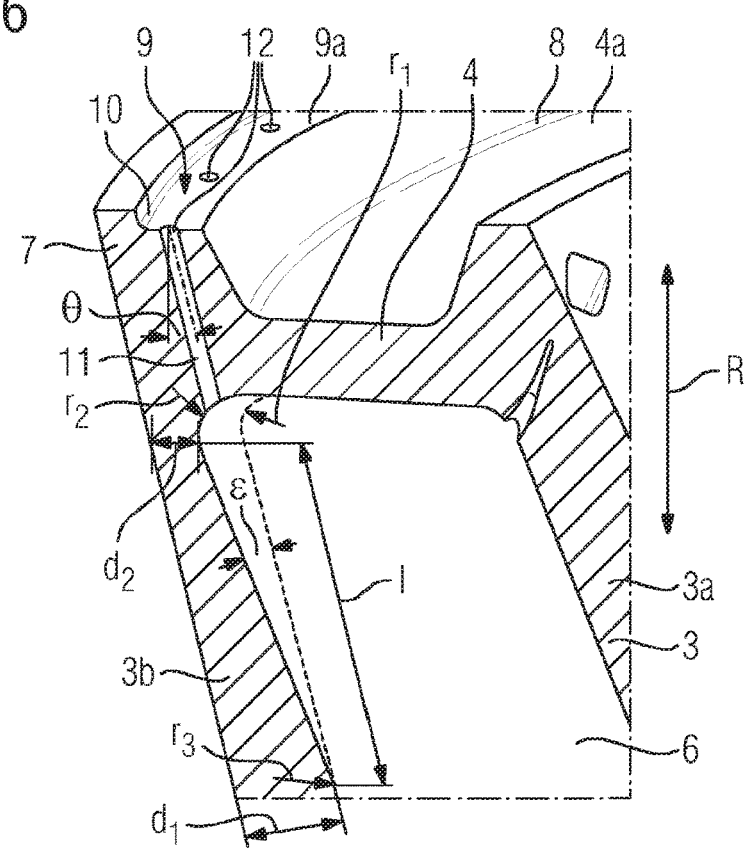
FIG. 6 shows an enlarged cross-sectional view of a blade airfoil of a rotor blade according to a fourth embodiment of the present invention, which corresponds to FIG. 3.
Figure 7:
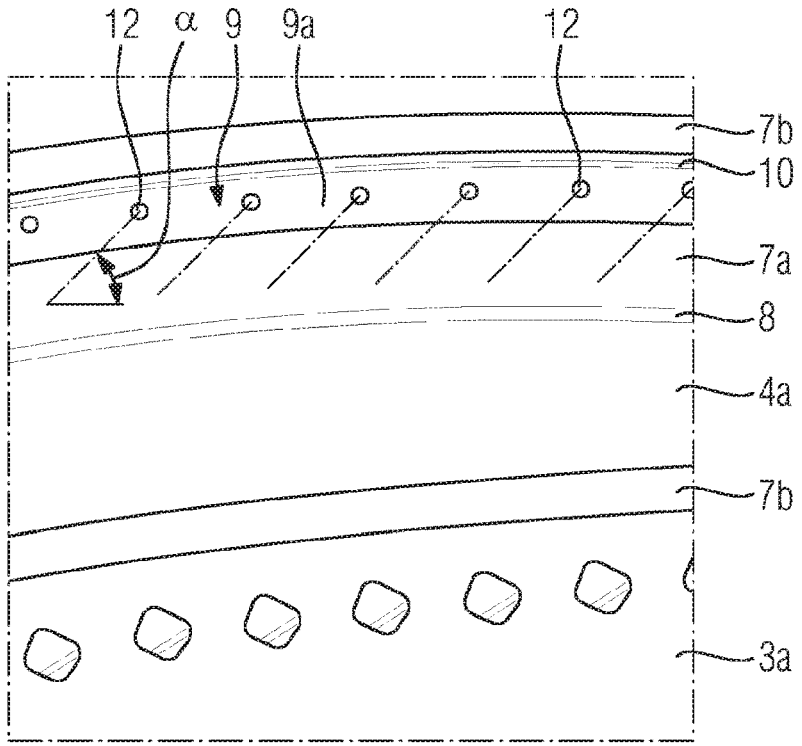
FIG. 7 shows an enlarged partial view of a blade airfoil of a rotor blade according to a fifth embodiment of the present invention, which corresponds to FIG. 2.

FIG. 6 shows a rotor blade for a gas turbine according to a fourth embodiment of the present invention. Said rotor blade differs from the hitherto described embodiments in that the peripheral wall 3 narrows in the direction of the crown base 4 in favor of the cavity 6. The thickness of the peripheral wall 3 is reduced in the process from an initial thickness $d_1$ to a narrowed thickness $d_2$ which is approximately half as large as the initial thickness $d_1$. The narrowing occurs over a radial section of the peripheral wall 3, the height 1 of which section is approximately five times as large as the initial thickness $d_1$. In the embodiment shown, the narrowing extends in a linear manner, that is to say the inner side of the peripheral wall 3 is planar and, in comparison with embodiments without narrowing of the peripheral wall 3, is inclined at an angle ε. Owing to the narrowing of the peripheral wall 3, the transverse inclination angle θ of the cooling ducts 11 is selected to be smaller such that the cooling ducts 11 extend closer to the outer side of the rubbing edge 7, as a result of which the convective cooling of the rubbing edge 7 is improved. The transition region to the crown base 4 is rounded, with the curvature being defined by a radius of curvature $r_2$, which can differ from the radius of curvature $r_1$ of embodiments without narrowing of the peripheral wall 3. In FIG. 7, a radius of curvature $r_2$ which is approximately twice as large as $r_1$ is illustrated. That transition region of the narrowing which is averted from the crown base 4 is rounded in order to avoid an edge, wherein the rounding is defined by a radius of curvature $r_3$.

FIG. 7 shows a rotor blade for a gas turbine according to a fifth embodiment of the present invention. Said rotor blade has the same basic structure as the above-described embodiments and differs from the hitherto described embodiments in that, in relation to a plane which is perpendicular to the radial direction R, the cooling ducts are inclined in the direction of the trailing edge of the rotor blade. Here, the third inclination angles α in the direction of the trailing edge of the rotor blade are measured in a plane which perpendicularly intersects the measurement plane of the first inclination angle δ, and are 45°. Consequently, the cooling ducts 11 have a longer length, as a result of which the convective cooling of the rubbing edge 7 is improved.

Figure 8:
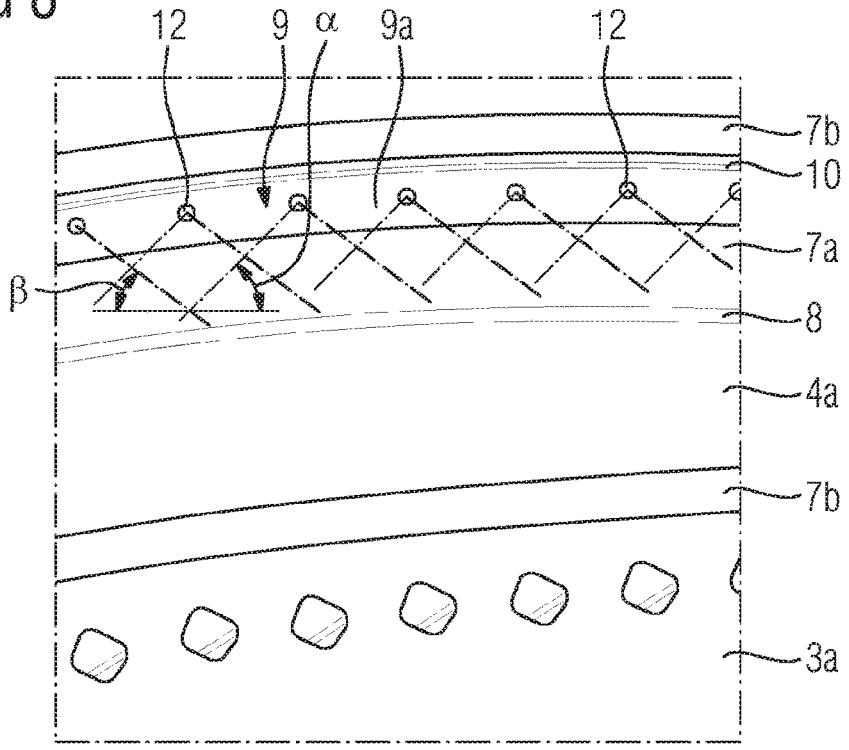
FIG. 8 shows an enlarged partial view of a blade airfoil of a rotor blade according to a sixth embodiment of the present invention, which corresponds to FIG. 2.

FIG. 8 shows a rotor blade for a gas turbine according to a sixth embodiment of the present invention. Said rotor blade differs from the embodiments illustrated in FIG. 7 in that there are provided further cooling ducts 11 which, in relation to a plane which is perpendicular to the radial direction R, are inclined in the direction of the leading edge of the rotor blade. Here, the fourth inclination angles θ in the direction of the trailing edge of the rotor blade are measured in a plane which perpendicularly intersects the measurement plane of the first inclination angle δ, and are 45°. In this rotor blade, the cooling ducts 11 of different inclination directions in each case mutually penetrate one another. However, alternatively, they may also cross without penetration, in particular if the cooling fluid outlet openings 12 are arranged in two mutually adjacently arranged rows. Also, it is possible for the fourth inclination angle θ to be selected so as to be different from the third inclination angle α.

One advantage of the rotor blade according to the invention is that the cooling ducts 11 are not or are only slightly clogged by way of material removal from the end surface 7*b* of the rubbing edge 7. This ensures cooling of the rubbing edge 7 which is uniform during the operation of the gas turbine, and thus a long service life of the rotor blade. A further advantage of the rotor blade according to the invention is that the depression 9 and the cooling ducts 11 are able to be produced easily. Owing to the low depth of the depression 9, effective cooling of the rubbing edge 7 over its overall height h remains possible. Moreover, the cooling fluid flowing out of the cooling fluid outlet openings 12 is scarcely deflected on its short path to the outer step of the rubbing edge 7 during the operation of the gas turbine, this being associated with effective cooling of the blade tip 5.

Although the invention has been more specifically illustrated and described in detail by the preferred exemplary embodiment, the invention is not limited by the examples disclosed, and other variations can be derived therefrom by a person skilled in the art without departing from the scope of protection of the invention.

The invention claimed is:

1. A rotor blade for a gas turbine, comprising a blade airfoil which extends in a radial direction and which has a blade airfoil body having a peripheral wall with a pressure-side wall section and a suction-side wall section, having a plate-like crown base which is connected to the peripheral wall in the region of the blade tip, and having a rubbing edge, wherein the peripheral wall and the crown base define a cavity in the blade airfoil body, and in the blade airfoil body there are formed cooling ducts which extend from the cavity to cooling fluid outlet openings provided in the rubbing edge, wherein, in the end surface of the rubbing edge, there is formed at least one depression into which at least some of the cooling ducts open such that the cooling fluid outlet openings are completely situated in a base region of the depression, wherein, with respect to the radial direction, the base region of the at least one depression is arranged between the end surface of the rubbing edge and the outer surface of the crown base, wherein the at least one depression extends as far as an inner side of the rubbing edge so as to form a stepped cross section, and wherein, in relation to the radial direction, an inner surface of the rubbing edge is outwardly inclined so as to form a first inclination angle, and measurement is carried out in a plane which extends in the radial direction and which perpendicularly intersects the rubbing edge, wherein the first inclination angle lies in the range of 0° to 45°, wherein each cooling duct is, in relation to a plane which is perpendicular to the radial direction, inclined in the direction of the leading edge of the rotor blade, or in the direction of the trailing edge of the rotor blade, so as to form a third and/or a fourth inclination angle, wherein the third inclination angle in the direction of the trailing edge of the rotor blade and the fourth inclination angle in the direction of the leading edge of the rotor blade are each measured in a plane which perpendicularly intersects the measurement plane of the first inclination angle and each lie in the range between 30° and 90°, such that, as a result of the arrangement of cooling duct which is inclined toward the leading edge, their cooling fluid jets are able to be conducted above the tip of the rubbing edge, arranged on the suction side, during operation, wherein the rubbing edge extends along the peripheral wall and is aligned on the outside with the peripheral wall and projects radially above the crown base, wherein the base region is formed as a planar base surface having a depth that is measured as a perpendicular distance between the base surface and the end surface of the rubbing edge, wherein the rubbing edge has an overall height that is measured as a perpendicular distance between the outer surface of the crown base and the end surface of the rubbing edge, and wherein the depth of the base region is less than the overall height of the rubbing edge.

2. The rotor blade as claimed in claim 1, wherein the depth of the base region is approximately 1 mm.

3. The rotor blade as claimed in claim 1, wherein the overall height of the rubbing edge is approximately 3 mm.

4. The rotor blade as claimed claim 1, wherein the first inclination angle is less than 30° and/or greater than 10°.

5. The rotor blade as claimed claim 1, wherein a step corner of the cross section is rounded.

6. The rotor blade as claimed in claim 5, wherein in the region of the at least one depression, the end surface of the rubbing edge has a width which is less than the thickness of the peripheral wall of the blade airfoil body in the region of the at least one depression.

7. The rotor blade as claimed in claim 5, wherein in the region of the at least one depression, the end surface of the rubbing edge has a width which is less than the width of the base region of the at least one depression.

8. The rotor blade as claimed in claim 5, wherein in the region of the at least one depression, the end surface of the rubbing edge and the base region of the depression have, in combination, a width which is approximately equal to the thickness of the peripheral wall of the blade airfoil body in the region of the at least one depression.

9. The rotor blade as claimed in claim 1, wherein the depression in the end surface of the rubbing edge is formed as a groove, with an outer end-surface section and an inner end-surface section being left in the process.

10. The rotor blade as claimed in claim 9, wherein, in the region of the depression, the width of the outer end-surface section and the width of the inner end-surface section of the rubbing edge each lie in the range of 0.5 mm to 5 mm, wherein the ratio between the outer width and the inner width lies in the range between 0.7 and 1.3.

11. The rotor blade as claimed in claim 1, wherein, in the region of the depression, the peripheral wall narrows in the direction of the crown base in favor of the cavity, wherein the thickness of the peripheral wall is reduced from an initial thickness to a narrowed thickness which is at least half as large as the initial thickness.

12. The rotor blade as claimed in claim 1, wherein the at least one depression is provided only in a section of the rubbing edge which projects from the suction-side wall section of the peripheral wall.

13. The rotor blade as claimed in claim 1, wherein precisely one depression is provided.

14. The rotor blade as claimed in claim 1, wherein there is provided a plurality of depressions which are arranged mutually adjacently in the peripheral direction, into each of which some of the cooling ducts open.

15. The rotor blade as claimed in claim 1, wherein, in the at least one depression, the cooling fluid outlet openings are, in the peripheral direction, arranged mutually adjacently and spaced apart from one another.

16. The rotor blade as claimed in claim 1, wherein each cooling duct extends rectilinearly and/or has a circular cross section with a diameter which lies in the range of 0.25 mm to 2 mm.

17. The rotor blade as claimed in claim 1, wherein the cooling ducts are widened in the region of the cooling fluid outlet openings.

18. The rotor blade as claimed in claim 16, wherein the cooling ducts are formed as bores.

19. The rotor blade as claimed in claim 1, wherein, in relation to the radial direction, the cooling ducts are inclined so as to form a second inclination angle, wherein the second inclination angles of the cooling ducts, which angles are each measured in a plane which extends in the radial direction and which perpendicularly intersects the rubbing edge, are equal or approximately equal to the first inclination angle of the inner surface of the rubbing edge.

20. The rotor blade as claimed in claim 16, wherein the third and/or fourth inclination angle are/is less than 80°.

21. The rotor blade as claimed in claim 1, wherein a transition region between an inner surface of the rubbing edge and the outer surface of the crown base is rounded.

22. The rotor blade as claimed in claim 1, wherein the blade airfoil body is produced by casting or in a generative process, or by means of 3D printing.

* * * * *